US008276383B2

(12) United States Patent
Sami

(10) Patent No.: US 8,276,383 B2
(45) Date of Patent: Oct. 2, 2012

(54) POWER GENERATOR USING AN ORGANIC RANKINE CYCLE DRIVE WITH REFRIGERANT MIXTURES AND LOW WASTE HEAT EXHAUST AS A HEAT SOURCE

(75) Inventor: Samuel M. Sami, Carlsbad, CA (US)

(73) Assignee: Acme Energy, Inc., Carlsbad, CA (US)

( * ) Notice: Subject to any disclaimer, the term of this patent is extended or adjusted under 35 U.S.C. 154(b) by 811 days.

(21) Appl. No.: 12/406,187

(22) Filed: Mar. 18, 2009

(65) Prior Publication Data

US 2010/0126172 A1 May 27, 2010

Related U.S. Application Data

(60) Provisional application No. 61/200,186, filed on Nov. 15, 2008.

(51) Int. Cl.
*F01K 25/08* (2006.01)

(52) U.S. Cl. ..... 60/651; 60/671

(58) Field of Classification Search ..... 60/651, 60/671; 252/67, 77

See application file for complete search history.

(56) References Cited

U.S. PATENT DOCUMENTS

| | | | | |
|---|---|---|---|---|
| 3,016,712 | A | 1/1962 | Taylor | |
| 3,277,651 | A | 10/1966 | Augsburger | |
| 4,055,049 | A | 10/1977 | Murphy et al. | |
| 4,651,531 | A | 3/1987 | Enjo et al. | |
| 4,651,533 | A | 3/1987 | Ura et al. | |
| 4,896,509 | A | 1/1990 | Tamura et al. | |
| 5,221,493 | A | 6/1993 | Merchant et al. | |
| 5,277,834 | A | 1/1994 | Bivens et al. | |
| 5,442,908 | A | 8/1995 | Briesch et al. | |
| 5,548,957 | A | 8/1996 | Salemie | |
| 5,603,218 | A | 2/1997 | Hooper | |
| 5,850,739 | A | 12/1998 | Masnoi | |
| 5,910,100 | A | 6/1999 | Hooper | |
| 6,101,813 | A | 8/2000 | Sami | |
| 6,221,273 | B1 * | 4/2001 | Basile et al. | 252/68 |
| 2006/0010872 | A1 | 1/2006 | Singh et al. | |
| 2007/0108403 | A1 | 5/2007 | Sievert et al. | |
| 2008/0157022 | A1 * | 7/2008 | Singh et al. | 252/68 |
| 2008/0314073 | A1 * | 12/2008 | Minor | 62/498 |

FOREIGN PATENT DOCUMENTS

| | | |
|---|---|---|
| WO | 92/13931 | 8/1992 |
| WO | 98/06791 | 2/1998 |

* cited by examiner

*Primary Examiner* — Hoang Nguyen
(74) *Attorney, Agent, or Firm* — Sand & Sebolt

(57) ABSTRACT

A Rankine cycle system uses as a refrigerant one of several quaternary organic heat exchange fluid mixtures which provide substantially improved efficiency and are environmentally sound, typically containing no chlorofluorocarbons (CFCs) or hydrochlorofluorocarbons (HCFCs). The system includes a closed circuit in which the refrigerant is used to drive a turbine, which may be used to drive an electric generator or for other suitable purposes.

20 Claims, 5 Drawing Sheets

POWER GENERATOR USING AN ORGANIC RANKINE CYCLE DRIVE WITH REFRIGERANT MIXTURES AND LOW WASTE HEAT EXHAUST AS A HEAT SOURCE

CROSS REFERENCE TO RELATED APPLICATION

This application claims priority from U.S. Provisional Patent Application Ser. No. 61/200,186, filed Nov. 25, 2008; the disclosure of which is incorporated herein by reference.

BACKGROUND OF THE INVENTION

1. Technical Field

The present invention relates to a Rankine cycle configured with a turbine and the organic refrigerants or heat exchange fluids used within the Rankine cycle to drive the turbine. More particularly, the present invention relates to a Rankine cycle and improved organic refrigerants which are particularly useful in driving an electric power generating system and which are highly suited to a wide range of heat sources for providing vapor regeneration of the refrigerants. The heat source may, for example, be exhaust combustion products of a fuel-fired device, hot liquid from a solar collector, geothermal wells, warm ocean waters or a number of other heat sources which typically represent heat sources the heat from which is not captured to provide useful energy or work.

2. Background Information

There is a need to provide electric power which is economical and reliable. There is also a need to provide electric power from sources of energy which are not dependent themselves on electric power to run component parts thereof but can also operate on electric grid in case of a failure of their own electrical power operating system. There is also the need to provide electric power during periods of transmission line power failures in order to maintain electrically-dependent equipment operative. There is also a need to recover energy loss through exhaust combustion products of fuel-fired boilers, for example, and to convert to reusable energy.

There is an urgent need for renewable energy. The renewable energy industry has experienced dramatic changes over the past few years. Deregulation of the electricity market failed to solve the industry's problems. Also, unanticipated increases in localized electricity demands and slower than expected growth in generating capacity have resulted in an urgent need for alternative energy sources, particularly those that are environmentally sound.

Consequently, the renewable energy industry is now in a far different situation than it was when headed into deregulation. Instead of struggling to compete in a competitive deregulated electricity market, renewable energy operators suddenly faced requests to accelerate deployment of new renewable energy capacities and restore facilities that had been closed due to poor economics.

Review of a renewable portfolio may provide some assurance to long term funding of renewable energy facilities and lead to a resurgence in new renewable energy facilities. However, a number of factors and issues will require development of these renewable energy facilities both in the short and long-term.

In the short term, there will be increasing pressure to deploy renewable energy facilities to help add generating capacity, improve system reliability, and stabilize electricity prices. However, the strategic installation of these renewable energy facilities will be hindered by a lack of understanding of how the renewable energy facilities integrate into the existing fossil-based generation systems.

In the long term, these renewable electricity generation systems will require development to benefit the current electricity system. These new systems will require an improved services capacity, be more efficient, relatively cheap to run and maintain and utilize ecologically-friendly chemicals. Developing such systems will largely be tied to growth in the renewable energy distributed generation systems, and will require an understanding and demonstration of renewable energy distributed generation systems which are used in combination with fossil-based generation.

Recent problems in electricity production emphasize the urgent need for a renewable approach to support the current electricity system, increase its existing capacity, and, equally important, benefit the environment by reducing the need to build more power plants and utilize environmentally-friendly chemicals.

One advantage of using organic compounds is that they do not need to be superheated. Unlike steam, organic compounds do not form liquid droplets upon expansion in the turbine. An absence of steam prevents erosion of the turbine blades and enables design flexibility on the heat exchangers.

An Organic Rankine Cycle (ORC) engine is a standard steam engine that utilizes heated vapor to drive a turbine. FIG. 1 illustrates the basic components of an Organic Rankine Cycle. However, this vapor is a heated organic chemical instead of a superheated water steam. The organic chemicals typically used by an ORC include Freon and most of the other traditional refrigerants, such as iso-pentane, chlorofluorocarbons (CFCs), hydrofluorocarbons (HFCs), butane, propane, and ammonia. The traditional refrigerants require high temperature heat sources between 100° C. (212° F.) and 143° C. (290° F.) and cannot operate at temperatures higher than 143° C. and less than 37° C. (100° F.). A refrigerant capable of operating outside these temperature ranges would thus be desirable.

BRIEF SUMMARY OF THE INVENTION

The present invention provides a system comprising a Rankine cycle closed circuit; a turbine within the closed circuit; and a refrigerant within the closed circuit configured for driving the turbine; wherein the refrigerant is one of a group of nine quaternary organic heat exchange fluid mixtures each having respective first, second, third and fourth components, the group consisting of (a) by weight, 1 to 97% HFC245ca, 1 to 97% HFC236ea, 1 to 97% HFC125 and 1 to 97% HFC152a; (b) by weight, 1 to 97% HFC236ea, 1 to 97% HFC134a, 1 to 97% HFC125 and 1 to 97% HFC152a; (c) by weight, 1 to 97% HFC245ca, 1 to 97% HFC134a, 1 to 97% HFC125 and 1 to 97% HFC152a; (d) by weight, 1 to 97% HFC236ea, 1 to 97% HFC245ca, 1 to 97% HFC365mfc and 1 to 97% HFC152a; (e) by weight, 1 to 97% HFC236ea, 1 to 97% HFC245ca, 1 to 97% HFC125 and 1 to 97% HFC365mfc; (f) by weight, 1 to 97% HFC245ca, 1 to 97% HFC236ea, 1 to 97% HFC134a and 1 to 97% HFC365mfc; (g) by weight, 1 to 97% HFC245fa, 1 to 97% HFC236fa, 1 to 97% HFC125 and 1 to 97% HFC134a; (h) by weight, 1 to 97% HFC236fa, 1 to 97% HFC134a, 1 to 97% HFC125 and 1 to 97% HFC152a; and (i) by weight, 1 to 97% HFC245fa, 1 to 97% HFC134a, 1 to 97% HFC125 and 1 to 97% HFC152a.

The system is typically configured so that the turbine drives an electric generator to produce electric power and may include a waste-heat boiler which typically uses exhaust combustion products from a fuel-fired device and/or a hot liquid device to provide a heat source for vapor regeneration of the refrigerants of the present invention at temperatures typically ranging from 23-480° C. (about 70-900° F.).

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
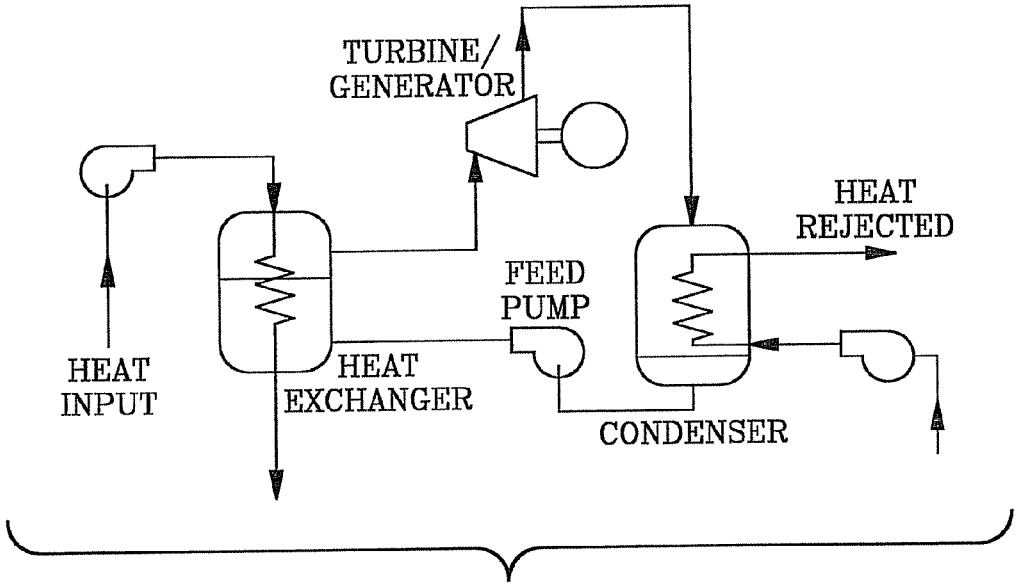
FIG. 1 is a schematic illustration of an electric power generating system constructed in accordance with the present invention.

The quaternary refrigerant mixtures of the present invention, which are described in greater detail further below, may be used with, for example, the organic Rankine cycle illustrated in FIG. 1 as well as that illustrated in FIGS. 4*a* and 4*b*, the latter being described in greater detail further below. FIG. 1 illustrates a more simple Rankine cycle configuration which includes a Rankine cycle closed loop or closed circuit through which the refrigerant cycles repeatedly. This closed loop includes a condenser, a pump downstream of the condenser, an evaporator or heat exchanger and a turbine within the closed loop which is operatively connected to a generator so that the rotation of the turbine drives the rotation of the generator to produce electrical energy. The turbine may be connected directly to the drive shaft of the generator or indirectly via gears or the like. The turbine may be a high pressure turbine, a low pressure turbine or for example an expander. Although the turbine is used to drive an electric generator in the exemplary embodiment, the turbine may also be used as a drive for other purposes. A heat source or heat input communicates via appropriate ducting and a blower or the like with the heat exchanger. Similarly, a blower or the like is used with appropriate ducts in communication with the condenser. The refrigerant leaves the condenser, after being cooled therein, in a liquid saturated state and is pumped by the feed pump to the heat exchanger or evaporator, where it is heated via the heat input whereby the refrigerant exits the evaporator or heat exchanger in a saturated vapor state. The refrigerant in this saturated vapor state is then fed to the turbine to drive its turbine blades and thus the rotation of the turbine in order to provide a rotational output, which may drive the electric generator or other mechanism. The refrigerant cools down and exits the turbine, and then enters the condenser where it is condensed back into its liquid state in order to begin its cycle once again.

Figure 2:
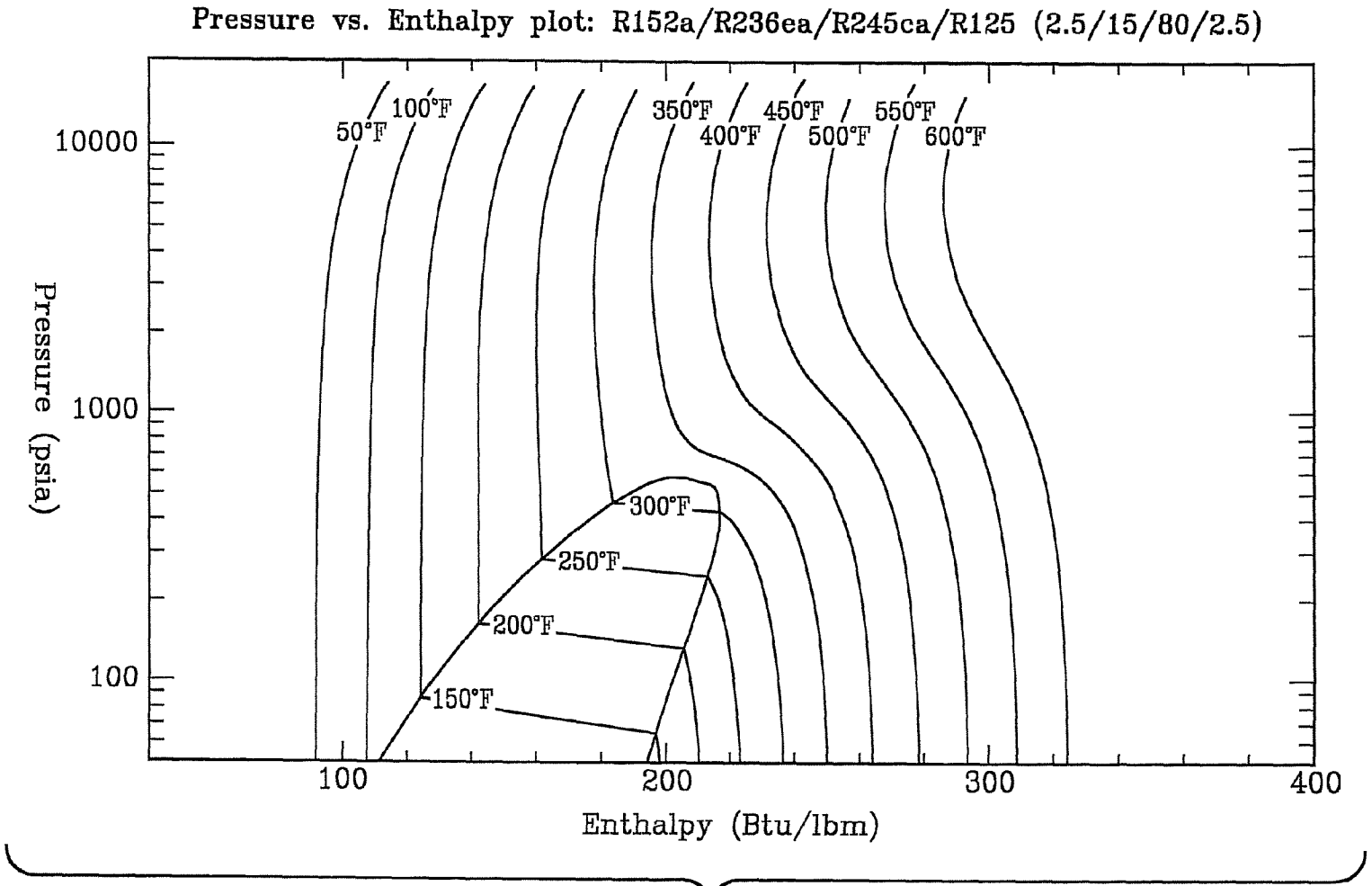
FIG. 2 is a graph illustrating the Enthalpy Pressure thermodynamic properties of a sample mixture of the present invention.
Figure 3:
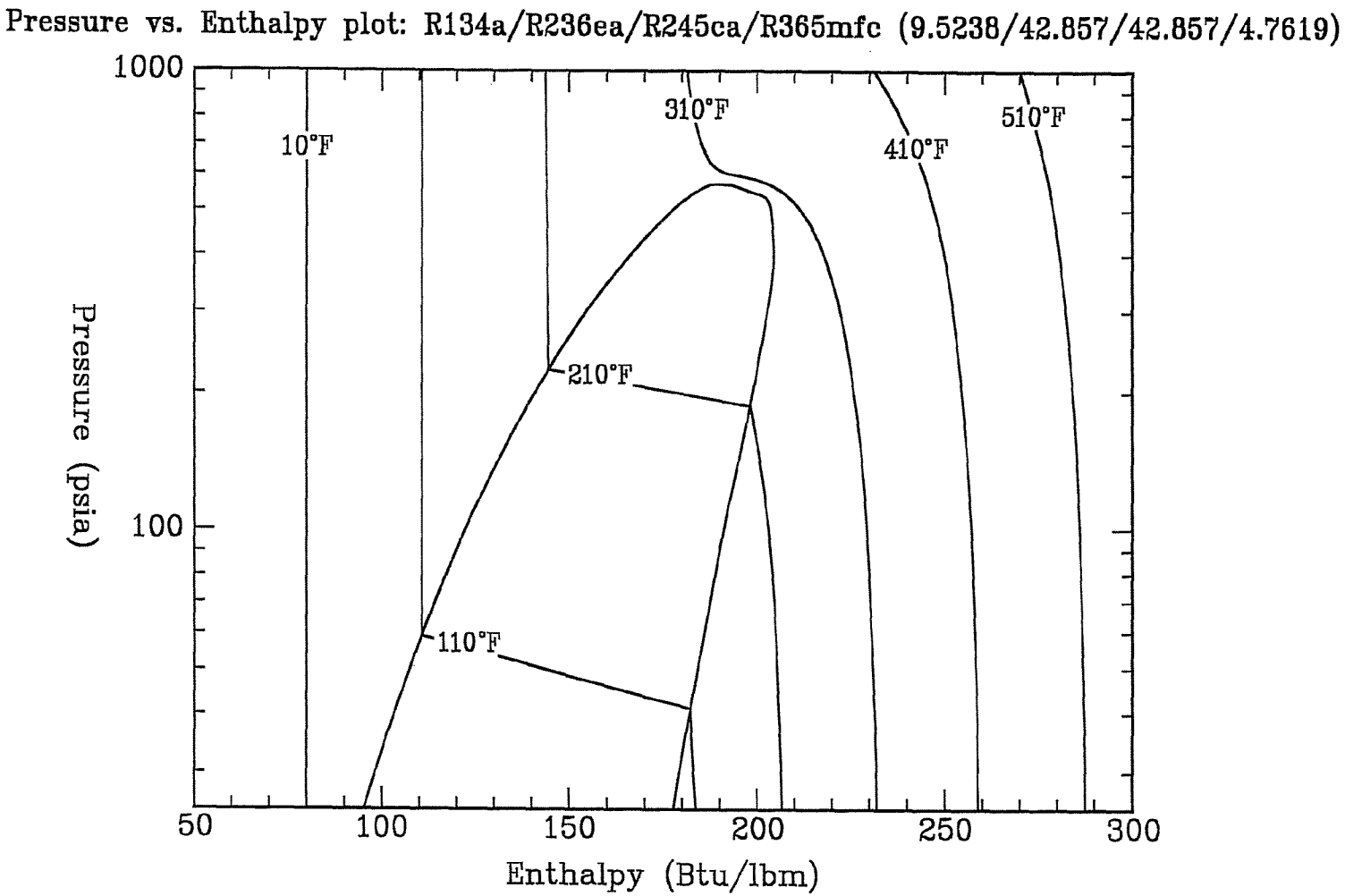
FIG. 3 is a graph illustrating the Enthalpy Pressure thermodynamic properties of another sample mixture of the present invention.

The refrigerants of the present invention, which are detailed more specifically below, are formed from the following components: HFC125 (pentafluoroethane, having a chemical formula of $C_2HF_5$); HFC134a (1,1,1,2-tetrafluoroethane, having a chemical formula of $C_2H_2F_4$); HFC236fa (1,1,1,3,3,3-hexafluoropropane, having a chemical formula of $C_3H_2F_6$); HFC236ea (1,1,1,2,3,3-hexafluoropropane, having a chemical formula of $C_3H_2F_6$); HFC245ca (1,1,2,2,3-pentafluoropropane, having a chemical formula of $C_3H_3F_5$); HFC245fa (1,1,1,3,3-pentafluoropropane, having a chemical formula of $C_3H_3F_5$); HFC365mfc (1,1,1,3,3-pentafluorobutane, having a chemical formula of $C_4H_5F_5$); and HFC152a (1,1-difluoroethane, having a chemical formula of $C_2H_4F_2$). The quaternary refrigerant mixtures of the present invention are different from the traditional pure refrigerants in that they boil at extremely low temperatures and are capable of capturing heat at temperatures less than 23° C. (73° F.), thus generating power from low and medium waste heat. FIGS. 2 and 3 present typical pressure-enthalpy diagrams of respective mixtures of the present invention where the saturation temperature varies at constant pressure. The degree of variation or gliding temperature depends upon the mixture components and their boiling points as well as thermodynamic and physical properties. More particularly, FIG. 2 illustrates a pressure enthalpy diagram in which R equals HFC whereby the specific mixture is formed of about 2.5% by weight HFC152a, about 15% by weight HFC236ea, about 80% by weight HFC245ca and about 2.5% by weight HFC125. Similarly, FIG. 3 represents one of the mixtures of the present invention which is formed by weight of about 9.5% HFC134a, about 42.9% HFC236ea, about 42.9% HFC245ca and about 4.8% HFC365mfc.

The composition of refrigerant mixtures can be adjusted to boil the mixture and generate power at a wide range of heat source temperatures from as low as 23° C. to 480° C. (about 70 to 900° F.). The refrigerant mixtures are characterized by variable saturation temperatures, and their boiling points can be tailored to maximize the heat absorption at the evaporator and produce an optimized power.

The quaternary refrigerant mixtures of the present invention can produce power from captured low and medium heat sources in applications such as process industries, solar energy and geothermal energy, gray water and warm ocean waters. Compared with using a typical fossil fuel, using the organic Rankine cycle with the refrigerant mixtures of the present invention significantly reduces the output of NOx (i.e., NO and $NO_2$) and $CO_2$. Further, the present quaternary refrigerant mixtures have a long life-cycle and require reduced maintenance and repair costs. These factors result in a relatively short payback period for the initial investment compared to existing ORC systems.

Figure 4A:
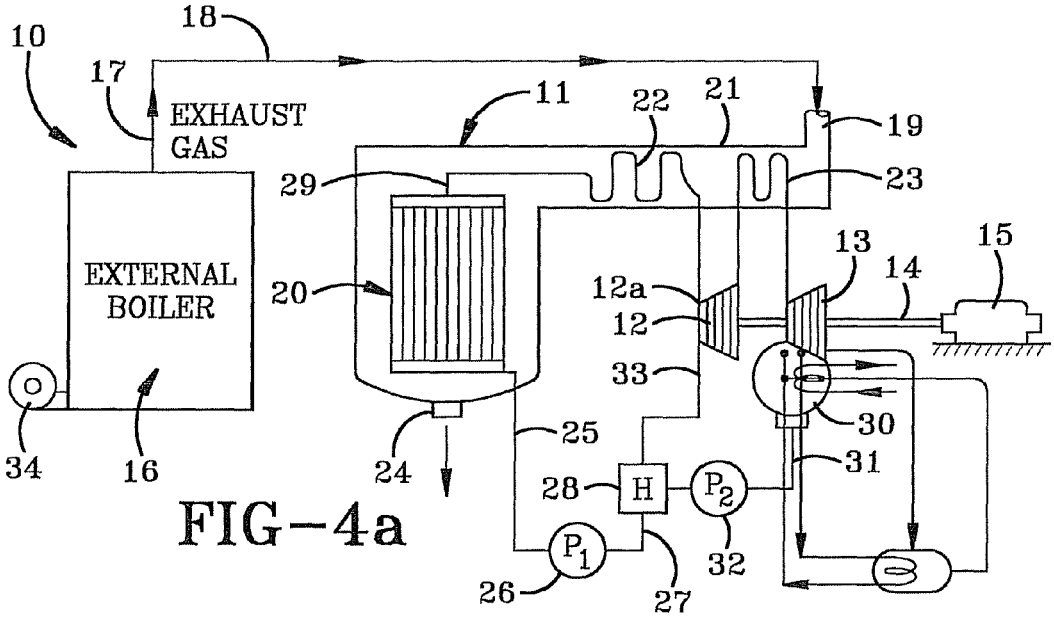
FIG. 4*a* is a schematic diagram illustrating two or more regenerative heaters connected in series in the Rankine cycle circuit.
Figure 4B:
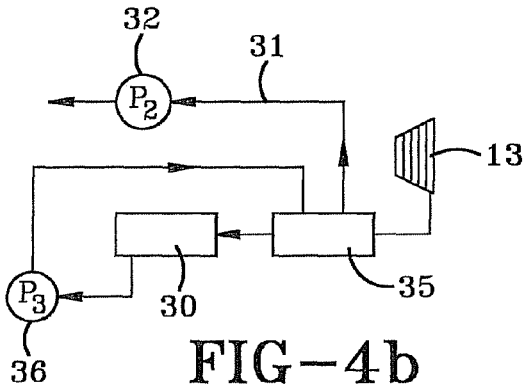
FIG. 4*b* is an enlarged schematic diagram of the encircled portion of FIG. 4*a*.

Referring now to the drawings and more particularly to FIGS. 4*a* and 4*b*, there is shown generally at 10 a preferred embodiment of the electric power generating system of the present invention. It is comprised of a waste-heat boiler 11 which is adapted to equipment normally found in a Rankine cycle to power turbines, herein a high pressure turbine 12 and a lower pressure turbine 13, which are connected to a common drive shaft 14 of an electric generator 15 to generate electric power. As noted with the Rankine cycle of FIG. 1, different types of turbines may be used including expanders.

Figure 5:
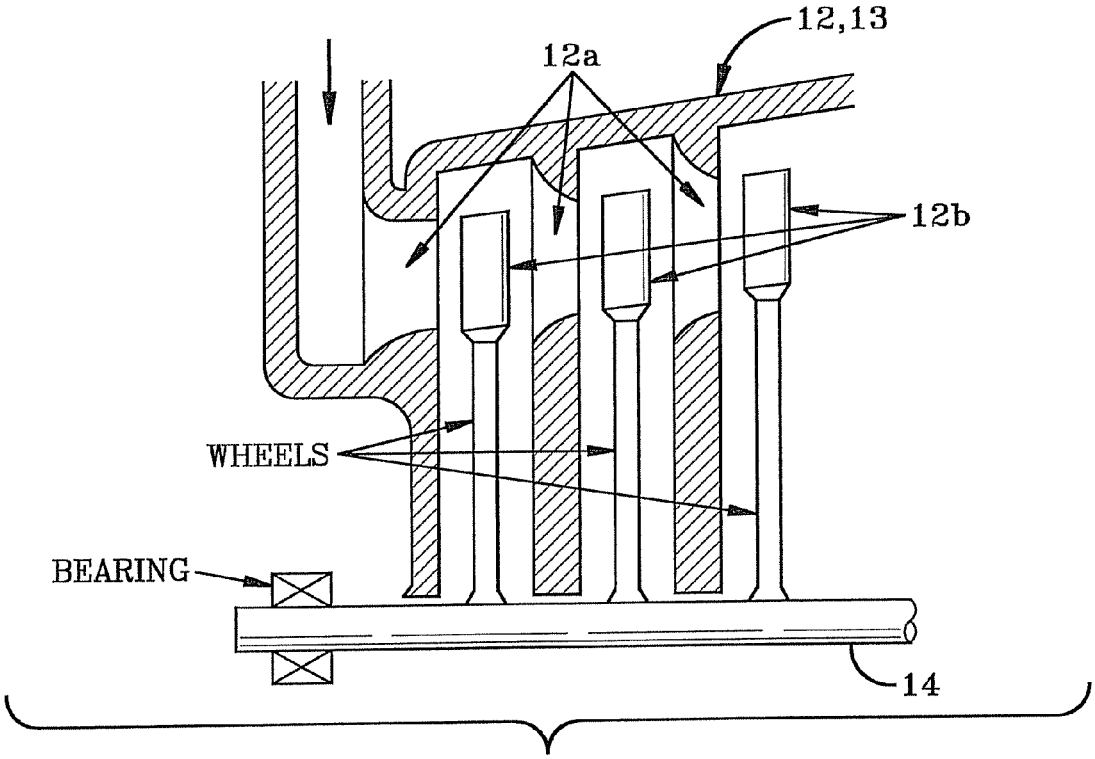
FIG. 5 is an enlarged schematic diagram of a portion of one of the turbines showing the turbine blades and corresponding entrance nozzles.

In addition, the turbines may be connected indirectly to the drive shaft or indirectly via gears or other drive mechanisms. Furthermore, the turbines may serve as a drive for mechanisms other than electric generators. The turbines 12 and 13 are also equipped with entrance nozzles 12*a*, to enhance the inlet vapor velocity. Nozzles 12*a* are shown enlarged in FIG. 5. In the electric power generating system of the present invention, the waste-heat boiler 11 uses exhaust combustion products from a fuel-fired device, such as an external boiler 16, or another heat source, as a source of heat for vapor regeneration of an organic heat exchange fluid mixture.

It is pointed out that the fuel-fired device more generally represents a heat source which may, for example, be a furnace, dryer, thermal combustion engine, turbine, fuel cell, or other such devices which generate hot products of combustion or reaction, or any heat source such hot air, hot fluids, hotspots or other geothermal heat sources, warm ocean waters, gray water and so forth. The system of the present invention is also suited to use as a heat source the waste heat which is typically held within water (or another liquid) and which would otherwise be cooled within a cooling tower. The present system could thus utilize this otherwise wasted heat energy and simultaneously eliminate the use of such cooling towers. It is noted that flue gases from a fuel-fired device are typically within the range of about 350 to 900° F. Most other pertinent applications including geothermal and solar applications and gray water typically provide a source of heat within a range of about 100 to 400° F. Warm ocean waters and the water or liquid which is in a cooling tower or which would otherwise be fed to a cooling tower are typically within the range of about 70 to 100° F.

As herein shown, the outlet 17 of the external boiler is connected via suitable ducting 18 to an inlet 19 of the waste-heat boiler 11. The products of combustion are convected through the waste-heat boiler 11 and pass through a duct segment 21 where a reheat exchanger 23 and a super-heat exchanger 22 are provided, whose purpose will be described later. The products of combustion or hot fluids and or hot air then pass through an evaporator 20 to heat the liquid organic fluid mixture, and the cooled products of combustion or other fluids, air etc. are then evacuated through the outlet duct 24. Of course, the waste-heat boiler may be arranged whereby the products of combustion enter at the bottom and rise through the boiler 11 to exit at the top.

The configuration of FIGS. 4*a* and 4*b* provide a more complex Rankine cycle closed circuit through which the refrigerant cycles. Within this closed circuit, the organic fluid mixture to be heated is fed to the waste-heat boiler 11 through an inlet conduit 25 by a pump 26 which is connected to the outlet 27 of a regenerative heater 28. The organic heat exchange fluid mixture at the inlet 25 is in a liquid saturated state after leaving the condenser 30, and at a temperature depending upon the heat source of a minimum of 7° C. (44° F.). This liquid saturated fluid passes through the regenerative heaters 28 and 35 where it is heated and then through the evaporator 20 where it absorbs heat from the products of combustion passing through the boiler 11. At the outlet 29 of the evaporator 20, the heat exchange fluid mixture is in the form of a saturated vapor which is then fed to a super-heat exchanger 22, in contact with the hot products of combustion, where the temperature of the fluid rises to a maximum of approximately 380° C. (716° F.) and changes to super-heated vapor. This super-heated organic fluid vapor mixture is then fed to the nozzles 12*a* (FIG. 5) of the high-pressure turbine 12 where it drives the turbine blades 12*b* connected to the drive shaft 14.

In the high-pressure turbine 12 some of the vapor of the super-heated fluid mixture, which has now cooled, is extracted and fed through a reheat exchanger coil 23 to be reheated by the hot products of combustion entering the boiler 11 via duct 21. This reheated vapor is now a low-pressure vapor and is used to drive the low-pressure turbine 13. As can be seen, the low pressure turbine 13 is also connected to the drive shaft 14 of the electric generator 15 to assist driving generator 15 to produce electric energy.

The organic heat exchange fluid mixture leaving the low pressure turbine 13 is in a saturated vapor state and is fed to and serves as a heat source for regenerative heater 35 (FIG. 4*b*). The saturated vapor is fed from heater 35 to condenser 30, which condenses the saturated vapor into its liquid phase, whereby this condensed liquid is pumped via a pump 36 (FIG. 4*b*) back through regenerative heater 35 where it is heated to a temperature of about 60° C. (140° F.). The outlet 31 of the condenser 30 is fed via heater 35 to a pump 32 which pumps this liquid heat exchange fluid mixture to regenerative heater 28, where it is rejoined and mixed with the hotter liquid heat exchange mixture fed thereto by the outlet conduit 33 of the high-pressure turbine 12. This rejoined mixture of heat exchange fluids, respectively at different temperatures, causes the temperature of the fluid mixtures from condenser 30 and turbine 12 to respectively rise and fall so that the rejoined liquid mixture exits the regenerative heater 28 via outlet 27 at about 70° C. (158° F.), where it is pumped by pump 26 to the inlet 25 of the waste-heat boiler and the entire cycle repeats itself.

The external boiler 16 is typically provided with a fuel-fired burner 34 or hot liquid device which could be a natural gas or oil burner or any other form of burner capable of producing a flame whereby combustion products are generated. The hot liquid device could be a solar or geothermal heat exchanger or any other capable device.

While FIGS. 4*a* and 4*b* illustrate modifications of the Rankine system using two turbines, it will be appreciated that more than two turbines may be connected to the drive shaft 14 and driven by the organic heat exchange fluid pressure. There may also be connected two or more regenerative heaters like heater 28 each of which would be fed with the liquid saturated hot vapors from the outlet conduit 33 of the high-pressure turbine to provide a cascade arrangement of regenerative heaters to increase the temperature of the saturated liquid to be fed to the inlet 25 of the waste-heat boiler 11.

The Rankine cycle turbines 12 and 13 are fully driven by the waste-heat boiler 11 using products of combustion from fuel-fired devices, such as boilers, or hot fluids or hot air and there is no need for any other thermal heat source. It is further pointed out that the heat exchange organic mixture is a multi-component mixture which enables the system to generate electricity at low temperatures and pressures. This is an important aspect of the present invention which permits the construction of the system in a much more economic manner as we are not concerned with problems inherent with high-pressure containers. The maximum super-heated mixture temperature is about 380° C. (716° F.) and the return liquid temperature to the waste heat boiler 11, at the inlet conduit 25 is at about 35° C. (95° F.) where condenser 30 is a water cooled condenser and about 20° C. (68° F.) where condenser 30 is an air cooled condenser.

The inlet and outlet vapor conditions at the waste-heat boiler 11 insure that the Rankine cycle operates at low risk pressures and temperatures and will also consume the minimum heat from the waste-heat boiler 11. Accordingly, the boiler efficiency is not compromised. The regenerative heaters 28 and 35 enhance the thermal efficiency of the organic Rankine cycle. By using multi-stage turbines the efficiency of the system can also be enhanced. However, the total number of regenerative heaters and turbine stages are determined by the economic viability of the unit to generate electricity.

The organic refrigerant mixtures used in the Rankine cycle are HFC based and preferably no CFCs or hydrochlorofluorocarbons (HCFCs) are used whereby the refrigerants of the present invention are preferably free of or substantially free of CFCs and HCFCs. The selection of the mixture components depends on the boiling temperature and pressure of the mixture and the ability to produce higher thermal energy between about 23° C. (73° F.) and about 480° C. (896° F.). The organic heat exchange fluid mixture can also be binary, ternary, or quaternary mixtures. From experience, it has been found that a quaternary refrigerant mixture produces the best benefits for an environmentally sound low-pressure system.

Figure 6:
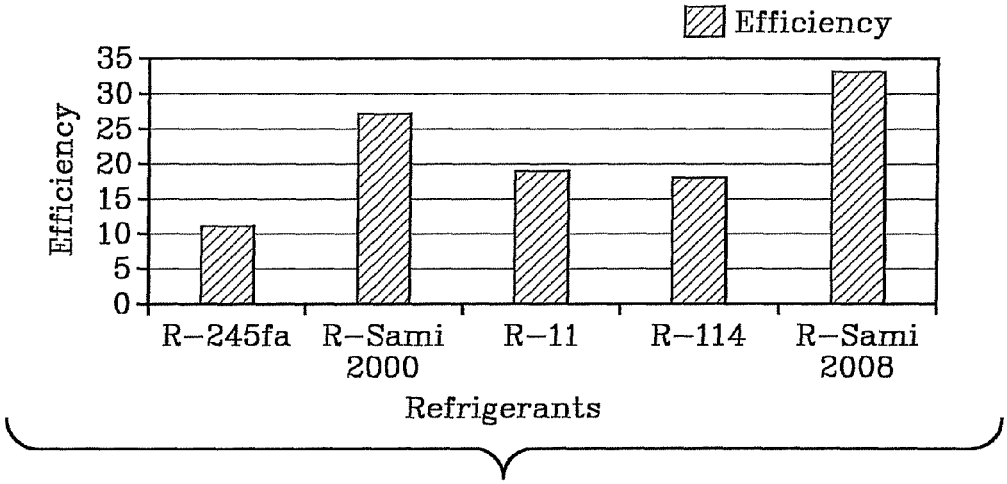
FIG. 6 is a graph illustrating a comparison between the efficiency of various fluids.

In order to determine the proper organic mixture, the cycle performance has been evaluated using various organic fluids and mixtures. It is calculated that any one of the nine quaternary refrigerant mixtures of the present invention listed below produces cycle efficiency of up to 30% or more using the present system compared to efficiencies of less than 10% for most existing refrigerants. The cycle efficiency is defined as the energy gained divided by the heat consumed and available at waste heat boiler. FIG. 6 illustrates the cycle efficiency of various refrigerants including one sample of the present refrigerant mixture, which is specified as R-Sami 2008. Although "R" generally stands for an HFC, a CFC or an HCFC, it is an HFC in the present mixture of the invention. FIG. 6 thus shows that R245fa has a cycle efficiency on the order of about 11%; R-Sami 2000 has a cycle efficiency on the order of about 22%; R-11 (also known as freon-11, CFC-11 and trichlorofluoromethane, having a chemical formula of $CCl_3F$) has a cycle efficiency on the order of about 19%; R-114 (1,2-dichlorotetrafluoroethane, having a chemical formula of $C_2Cl_2F_4$) has a cycle efficiency on the order of about 18%; and the present mixture R-Sami 2008 has an efficiency on the order of about 33%. R-Sami 2000 represents the refrigerant discussed in U.S. Pat. No. 6,101,813, namely a quaternary mixture of, by weight, 70% HCFC123 (2,2-dichloro-1,1,1-triflouroethane, with a chemical formula of $C_2HCl_2F_3$), 10% HFC134a, 10% HCFC124 (2-chloro-1,1,1,2-tetraflouroethane, with a chemical formula of $C_2HClF_4$) and 10% HFC125.

Figure 7:
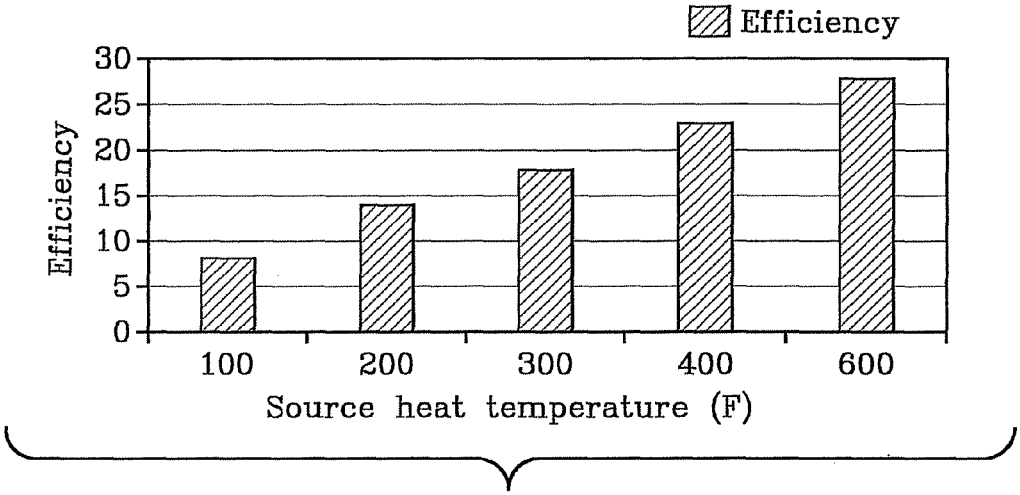
FIG. 7 is a graph illustrating a comparison between efficiency of various fluids at various temperatures.

R-Sami 2008 shown in FIG. 6 may be any one of the below-listed mixtures in which the first and second components are each about 40% by weight while the third and fourth components are each about 10% by weight (which are the second embodiments of the pertinent refrigerants, as detailed further below). Although the percentages of these components for the mixtures may fall within a relatively broad range, the preferred mixtures are usually within about plus or minus 5% by weight of the above noted percentages. It is noted, for instance, that the refrigerant of FIG. 3 falls within these proportions. FIG. 7 illustrates the cycle efficiency for R-Sami 2008 for different source heat temperatures and shows an increasing efficiency from 100° F. (38° C.) up to 600° F. (316° C.). Under the specific circumstances, the efficiency of R-Sami 2008 at a source temperature of 100° F. (38° C.) is on the order of about 8%, at 200° F. (93° C.) is on the order of about 14%, at 300° F. (149° C.) is on the order of about 18%, at 400° F. (204° C.) is on the order of about 23%, and at 600° F. (316° C.) is on the order of about 28%.

The nine refrigerants or quaternary heat exchange fluids of the present invention are broadly as follows:

1. HFC245ca, HFC236ea, HFC125 and HFC152a, with proportions of 1.0 to 97.0%, 1.0 to 97.0%, 1.0 to 97.0% and 1.0 to 97.0% by weight respectively.
2. HFC236ea, HFC134a, HFC125 and HFC152a, with proportions of 1.0 to 97.0%, 1.0 to 97.0%, 1.0 to 97.0% and 1.0 to 97.0% by weight respectively.
3. HFC245ca, HFC134a, HFC125 and HFC152a, with proportions of 1.0 to 97.0%, 1.0 to 97.0%, 1.0 to 97.0% and 1.0 to 97.0% by weight respectively.
4. HFC236ea, HFC245ca, HFC365mfc and HFC152a, with proportions of 1.0 to 97.0%, 1.0 to 97.0%, 1.0 to 97.0% and 1.0 to 97.0% by weight respectively.
5. HFC236ea, HFC245ca, HFC125 and HFC365mfc, with proportions of 1.0 to 97.0%, 1.0 to 97.0%, 1.0 to 97.0% and 1.0 to 97.0% by weight respectively.
6. HFC245ca, HFC236ea, HFC134a and HFC365mfc, with proportions of 1.0 to 97.0%, 1.0 to 97.0%, 1.0 to 97.0% and 1.0 to 97.0% by weight respectively.
7. HFC245fa, HFC236fa, HFC125 and HFC134a, with proportions of 1.0 to 97.0%, 1.0 to 97.0%, 1.0 to 97.0% and 1.0 to 97.0% by weight respectively.
8. HFC236fa, HFC134a, HFC125 and HFC152a, with proportions of 1.0 to 97.0%, 1.0 to 97.0%, 1.0 to 97.0% and 1.0 to 97.0% by weight respectively.
9. HFC245fa, HFC134a, HFC125 and HFC152a, with proportions of 1.0 to 97.0%, 1.0 to 97.0%, 1.0 to 97.0% and 1.0 to 97.0% by weight respectively.

For all nine of the above listed refrigerants of the present invention, a first preferred embodiment includes by weight for the respective refrigerant about 60 to 90% of the first component, 2 to 35% of the second component, 2 to 35% of the third component, and 2 to 35% of the fourth component. However, it is noted that HFC125 where used preferably does not exceed about 25% by weight and more preferably no more than about 20%. In addition, it is preferred that neither HFC152a nor HFC365mfc respectively makes up more than about 15% and more preferably no more than about 10% by weight of a given mixture. The percentages for each component of the first preferred embodiment of the nine refrigerants may fall within narrower ranges, such as those recited respectively within the nine paragraphs which follow immediately below.

The current paragraph provides the various percentages by weight of the first embodiment of refrigerant number 1 of the present invention. The first component of refrigerant number 1, HFC245ca, makes up about 60 to 90% of the refrigerant and in the preferred embodiment about 80%. Thus, HFC245ca most typically makes up somewhere in the range of about 65, 70, or 75% to about 85 or 90% of refrigerant number 1. The second component, HFC236ea, makes up typically about 2 to 30 or 35%, and about 15% in the preferred embodiment. Thus, HFC236ea most typically makes up about 5 or 10% to about 20, 25 or 30% of refrigerant number 1. The third component, HFC125, typically makes up about 2 to 20 or 25% of refrigerant number 1, and about 2.5% in the preferred embodiment. Thus, HFC125 most typically makes up about 2 to 5, 10, 15 or 20% of refrigerant number 1. The fourth component, HFC152a, typically makes up about 2 to 15%, and in the exemplary embodiment about 2.5%. Most typically, HFC152a makes up about 2% to about 5 or 10% of refrigerant number 1. Another preferred embodiment, for example, within the preferred percentages noted above in this paragraph is a mixture of 60% HFC245ca, 20% HFC236ea, 10% HFC125 and 10% HFC152a.

The current paragraph provides the various percentages by weight of the first embodiment of refrigerant number 2 of the present invention. The first component of refrigerant number 2, HFC236ea, makes up about 60 to 90% of the refrigerant and in the preferred embodiment about 75%. Thus, HFC236ea most typically makes up somewhere in the range of about 65 or 70% to about 80 or 85% of refrigerant number 2. The second component, HFC134a, makes up typically about 2 to 30 or 35%, and about 10% in the preferred embodiment. Thus, HFC134a most typically makes up about 5% to about 15, 20 or 25% of refrigerant number 2. The third component, HFC125, typically makes up about 2 to 20 or 25% of refrigerant number 2, and about 10% in the preferred embodiment. Thus, HFC125 most typically makes up about 5 to 15 or 20% of refrigerant number 2. The fourth component, HFC152a, typically makes up about 2 to 15%, and in the exemplary embodiment about 5%. Most typically, HFC152a makes up about 2% to about 10% of refrigerant number 2. Another preferred embodiment, for example, within the preferred percentages noted above in this paragraph is a mixture of 70% HFC236ea, 10% HFC134a, 10% HFC125 and 10% HFC152a.

The current paragraph provides the various percentages by weight of the first embodiment of refrigerant number 3 of the present invention. The first component of refrigerant number 3, HFC245ca, makes up about 60 to 90% of the refrigerant and in the preferred embodiment about 75%. Thus, HFC245ca most typically makes up somewhere in the range of about 65 or 70% to about 80 or 85% of refrigerant number 3. The second component, HFC134a, makes up typically about 2 to 30 or 35%, and about 10% in the preferred embodiment. Thus, HFC134a most typically makes up about 5% to about 15, 20 or 25% of refrigerant number 3. The third component, HFC125, typically makes up about 2 to 20 or 25% of refrigerant number 3, and about 10% in the preferred embodiment. Thus, HFC125 most typically makes up about 5 to 15 or 20% of refrigerant number 3. The fourth component, HFC152a, typically makes up about 2 to 15%, and in the exemplary embodiment about 5%. Most typically, HFC152a makes up about 2% to about 10% of refrigerant number 3. Another preferred embodiment, for example, within the preferred percentages noted above in this paragraph is a mixture of 60% HFC245ca, 20% HFC134a, 10% HFC125 and 10% HFC152a.

The current paragraph provides the various percentages by weight of the first embodiment of refrigerant number 4 of the present invention. The first component of refrigerant number 4, HFC236ea, makes up about 60 to 90% of the refrigerant and in the preferred embodiment about 80%. Thus, HFC236ea most typically makes up somewhere in the range of about 65, 70, or 75% to about 85 or 90% of refrigerant number 4. The second component, HFC245ca, makes up typically about 2 to 30 or 35%, and about 10% in the preferred embodiment. Thus, HFC245ca most typically makes up about 5% to about 15, 20 or 25% of refrigerant number 4. The third component, HFC365mfc, typically makes up about 2 to 10 or 15% of refrigerant number 4, and about 5% in the preferred embodiment. Thus, HFC365mfc most typically makes up about 2 to 10% of refrigerant number 4. The fourth component, HFC152a, typically makes up about 2 to 15%, and in the exemplary embodiment about 2.5%. Most typically, HFC152a makes up about 2% to about 5 or 10% of refrigerant number 4.

The current paragraph provides the various percentages by weight of the first embodiment of refrigerant number 5 of the present invention. The first component of refrigerant number 5, HFC236ea, makes up about 60 to 90% of the refrigerant and in the preferred embodiment about 70%. Thus, HFC236ea most typically makes up somewhere in the range of about 65% to about 75, 80 or 85% of refrigerant number 5. The second component, HFC245ca, makes up typically about 2 to 30 or 35%, and about 10% in the preferred embodiment. Thus, HFC245ca most typically makes up about 5% to about 15, 20 or 25% of refrigerant number 5. The third component, HFC125, typically makes up about 2 to 20 or 25% of refrigerant number 5, and about 10% in the preferred embodiment. Thus, HFC125 most typically makes up about 5 to 15 or 20% of refrigerant number 5. The fourth component, HFC365mfc, typically makes up about 2 to 15%, and in the exemplary embodiment about 10%. Most typically, HFC365mfc makes up about 2% to about 10% of refrigerant number 5.

The current paragraph provides the various percentages by weight of the first embodiment of refrigerant number 6 of the present invention. The first component of refrigerant number 6, HFC245ca, makes up about 60 to 90% of the refrigerant and in the preferred embodiment about 70%. Thus, HFC245ca most typically makes up somewhere in the range of about 65% to about 75, 80 or 85% of refrigerant number 6. The second component, HFC236ea, makes up typically about 2 to 30 or 35%, and about 10% in the preferred embodiment. Thus, HFC236ea most typically makes up about 5% to 15, 20 or 25% of refrigerant number 6. The third component, HFC134a, typically makes up about 2 to 30 or 35% of refrigerant number 6, and about 10% in the preferred embodiment. Thus, HFC134a most typically makes up about 5 to 15, 20 or 25% of refrigerant number 6. The fourth component, HFC365mfc, typically makes up about 2 to 15%, and in the exemplary embodiment about 10%. Most typically, HFC365mfc makes up about 2% to about 10% of refrigerant number 6.

The current paragraph provides the various percentages by weight of the first embodiment of refrigerant number 7 of the present invention. The first component of refrigerant number 7, HFC245fa, makes up about 60 to 90% of the refrigerant and in the preferred embodiment about 70%. Thus, HFC245fa most typically makes up somewhere in the range of about 65% to about 75, 80 or 85% of refrigerant number 7. The second component, HFC236fa, makes up typically about 2 to 30 or 35%, and about 10% in the preferred embodiment. Thus, HFC236fa most typically makes up about 5% to 15, 20 or 25% of refrigerant number 7. The third component, HFC125, typically makes up about 2 to 20 or 25% of refrigerant number 7, and about 10% in the preferred embodiment. Thus, HFC125 most typically makes up about 5 to 15 or 20% of refrigerant number 7. The fourth component, HFC134a, typically makes up about 2 to 30 or 35% of refrigerant number 7, and about 10% in the preferred embodiment. Thus, HFC134a most typically makes up about 5 to 15, 20 or 25% of refrigerant number 7.

The current paragraph provides the various percentages by weight of the first embodiment of refrigerant number 8 of the present invention. The first component of refrigerant number 8, HFC236fa, makes up about 60 to 90% of the refrigerant and in the preferred embodiment about 75%. Thus, HFC236fa most typically makes up somewhere in the range of about 65 or 70% to about 80 or 85% of refrigerant number 8. The second component, HFC134a, makes up typically about 2 to 30 or 35%, and about 10% in the preferred embodiment. Thus, HFC134a most typically makes up about 5% to about 15, 20 or 25% of refrigerant number 8. The third component, HFC125, typically makes up about 2 to 20 or 25% of refrigerant number 8, and about 10% in the preferred embodiment. Thus, HFC125 most typically makes up about 5 to 15 or 20% of refrigerant number 8. The fourth component, HFC152a, typically makes up about 2 to 15%, and in the exemplary embodiment about 5%. Most typically, HFC152a makes up about 2% to about 10% of refrigerant number 8. Another preferred embodiment, for example, within the preferred percentages noted above in this paragraph is a mixture of 70% HFC236fa, 10% HFC134a, 10% HFC125 and 10% HFC152a.

The current paragraph provides the various percentages by weight of the first embodiment of refrigerant number 9 of the present invention. The first component of refrigerant number 9, HFC245fa, makes up about 60 to 90% of the refrigerant and in the preferred embodiment about 75%. Thus, HFC245fa most typically makes up somewhere in the range of about 65 or 70% to about 80 or 85% of refrigerant number 9. The second component, HFC134a, makes up typically about 2 to 30 or 35%, and about 10% in the preferred embodiment. Thus, HFC134a most typically makes up about 5% to about 15, 20 or 25% of refrigerant number 9. The third component, HFC125, typically makes up about 2 to 20 or 25% of refrigerant number 9, and about 10% in the preferred embodiment. Thus, HFC125 most typically makes up about 5 to 15 or 20% of refrigerant number 9. The fourth component, HFC152a, typically makes up about 2 to 15%, and in the exemplary embodiment about 5%. Most typically, HFC152a makes up about 2% to about 10% of refrigerant number 9. Another preferred embodiment, for example, within the preferred percentages noted above in this paragraph is a mixture of 60% HFC245fa, 20% HFC134a, 10% HFC125 and 10% HFC152a.

For above listed refrigerants number 1 and 4, 5, 6 and 7 of the present invention, a second preferred embodiment includes by weight for the respective refrigerant about 20 to 55 or 60% of the first component, 20 to 55 or 60% of the second component, 2 to 35% of the third component, and 2 to 35% of the fourth component. As noted above, it is preferred that HFC125 where used does not exceed about 25% by weight and more preferably no more than about 20%. As also noted above, it is preferred that neither HFC152a nor HFC365mfc respectively makes up more than about 15% and more preferably no more than about 10% by weight of a given mixture. The percentages for each component of the second preferred embodiment of these five refrigerants may fall within narrower ranges, such as those recited respectively within the five paragraphs which follow immediately below.

The current paragraph provides the various percentages by weight of the second embodiment of refrigerant number 1 of the present invention. The first component of refrigerant number 1, HFC245ca, makes up about 20 to 50, 55 or 60% of the refrigerant and in the preferred embodiment about 40%. Thus, HFC245ca typically makes up somewhere in the range of about 25, 30, or 35% to about 45, 50 or 55% and most typically about 35% to about 45% of refrigerant number 1. The second component, HFC236ea, makes up typically about 20 to 50, 55 or 60%, and about 40% in the preferred embodiment. Thus, HFC236ea typically makes up about 25, 30, or 35% to about 45, 50 or 55% and most typically about 35% to about 45% of refrigerant number 1. The third component, HFC125, typically makes up about 2 to 20 or 25% of refrigerant number 1, and about 10% in the preferred embodiment. Thus, HFC125 typically makes up about 2 or 5% to 15 or 20% and most typically about 5% to about 15% of refrigerant number 1. The fourth component, HFC152a, typically makes up about 2 to 15%, and in the exemplary embodiment about 10%. Most typically, HFC152a makes up about 5% to about 10% of refrigerant number 1.

The current paragraph provides the various percentages by weight of the second embodiment of refrigerant number 4 of the present invention. The first component of refrigerant number 4, HFC236ea, makes up typically about 20 to 50, 55 or 60% of the refrigerant and in the preferred embodiment about 40%. Thus, HFC236ea typically makes up somewhere in the range of about 25, 30, or 35% to about 45% and most typically about 35% to about 45% of refrigerant number 4. The second component, HFC245ca, makes up typically about 20 to 50, 55 or 60% of the refrigerant and in the preferred embodiment about 40%. Thus, HFC245ca typically makes up somewhere in the range of about 25, 30, or 35% to about 45, 50 or 55% and most typically about 35% to about 45% of refrigerant number 4. The third component, HFC365mfc, typically makes up about 2 to 15%, and in the exemplary embodiment about 10%. Most typically, HFC365mfc makes up about 5% to about 10% of refrigerant number 4. The fourth component, HFC152a, typically makes up about 2 to 15%, and in the exemplary embodiment about 10%. Most typically, HFC152a makes up about 5% to about 10% of refrigerant number 4.

The current paragraph provides the various percentages by weight of the second embodiment of refrigerant number 5 of the present invention. The first component of refrigerant number 5, HFC236ea, makes up about 20 to 50, 55 or 60% of the refrigerant and in the preferred embodiment about 40%. Thus, HFC236ea typically makes up somewhere in the range of about 25, 30, or 35% to about 45, 50 or 55% and most typically about 35% to about 45% of refrigerant number 5. The second component, HFC245ca, makes up typically about 20 to 50, 55 or 60% of the refrigerant and in the preferred embodiment about 40%. Thus, HFC245ca typically makes up somewhere in the range of about 25, 30, or 35% to about 45, 50 or 55% and most typically about 35% to about 45% of refrigerant number 5. The third component, HFC125, typically makes up about 2 to 20 or 25% of refrigerant number 5, and about 10% in the preferred embodiment. Thus, HFC125 typically makes up about 2 or 5% to 15 or 20% and most typically about 5% to about 15% of refrigerant number 5. The fourth component, HFC365mfc, typically makes up about 2 to 15%, and in the exemplary embodiment about 10%. Most typically, HFC365mfc makes up about 5% to about 10% of refrigerant number 5.

The current paragraph provides the various percentages by weight of the second embodiment of refrigerant number 6 of the present invention. The first component of refrigerant number 6, HFC245ca, makes up about 20 to 50, 55 or 60% of the refrigerant and in the preferred embodiment about 40%. Thus, HFC245ca typically makes up somewhere in the range of about 25, 30, or 35% to about 45, 50 or 55% and most typically about 35% to about 45% of refrigerant number 6. The second component, HFC236ea, makes up typically about 20 to 50, 55 or 60% of the refrigerant and in the preferred embodiment about 40%. Thus, HFC236ea typically makes up somewhere in the range of about 25, 30, or 35% to about 45, 50 or 55% and most typically about 35% to about 45% of refrigerant number 6. The third component, HFC134a, typically makes up about 2 to 30 or 35% of refrigerant number 6, and about 10% in the preferred embodiment. Thus, HFC134a most typically makes up about 5 to 15, 20 or 25% and usually about 5% to about 15% of refrigerant number 6. The fourth component, HFC365mfc, typically makes up about 2 to 15%, and in the exemplary embodiment about 10%. Most typically, HFC365mfc makes up about 5% to about 10% of refrigerant number 6.

The current paragraph provides the various percentages by weight of the first embodiment of refrigerant number 7 of the present invention. The first component of refrigerant number 7, HFC245fa, makes up about 20 to 50, 55 or 60% of the refrigerant and in the preferred embodiment about 40%. Thus, HFC245fa typically makes up somewhere in the range of about 25, 30, or 35% to about 45, 50 or 55% and most typically about 35% to about 45% of refrigerant number 7. The second component, HFC236fa, makes up typically about 20 to 50, 55 or 60% of the refrigerant and in the preferred embodiment about 40%. Thus, HFC236fa typically makes up somewhere in the range of about 25, 30, or 35% to about 45, 50 or 55% and most typically about 35% to about 45% of refrigerant number 7. The third component, HFC125, typically makes up about 2 to 20 or 25% of refrigerant number 7, and about 10% in the preferred embodiment. Thus, HFC125 typically makes up about 2 or 5% to 15 or 20% and most typically about 5% to about 15% of refrigerant number 7. The fourth component, HFC134a, typically makes up about 2 to 30 or 35% of refrigerant number 7, and about 10% in the preferred embodiment. Thus, HFC134a most typically makes up about 5 to 15, 20 or 25% and usually about 5% to about 15% of refrigerant number 7.

As noted within the paragraphs above regarding the second embodiments of the refrigerants, each of the first and second components of each second embodiment falls within the range of about 20 to 50, 55 or 60%. The percentage range for the first and second components of the corresponding first embodiments is about 60% to 90%. It is thus clear that the first and second embodiments overlap with regard to the ranges recited for these first and second components. Thus, the range of percentages for each of HFC245ca, HFC245fa, HFC236ea and HFC236fa typically falls within the range of about 20% to 90%.

Based on the environmental information available on the components of the present organic mixtures, they are believed to be environmentally sound. Furthermore, the pressure ratio of the proposed mixtures under the operating conditions as discussed above is comparable and acceptable such that a system such as system 10 is not considered as a high pressure vessel. Therefore, the proposed system is acceptable for all typical applications of fuel-fired devices.

Figure 8:
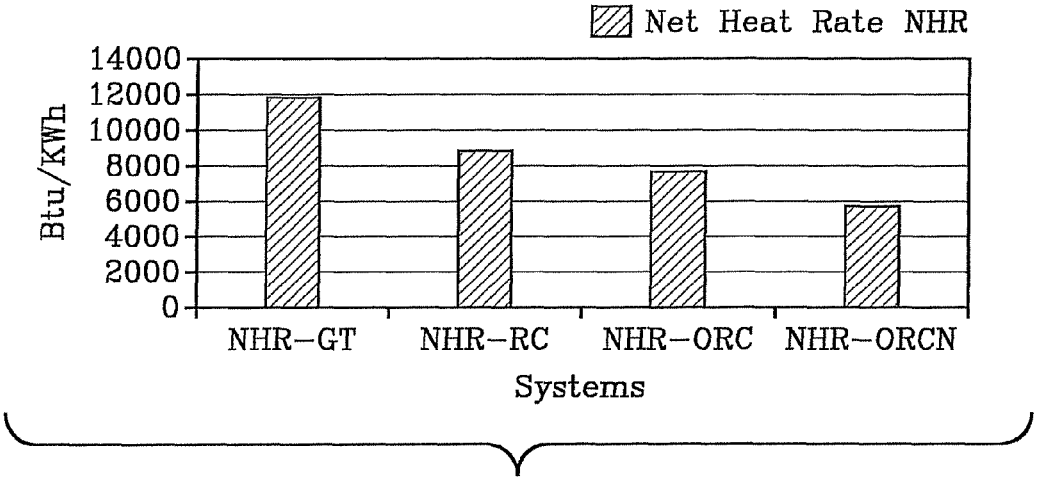
FIG. 8 is a graph illustrating a comparison between the net heat rate of various fluids.

FIG. 8 compares the net heat rate (NHR) of several Rankine cycle systems to show the significant operational energy savings when quaternary mixtures of the present invention are used. In FIG. 8, NHR-GT represents the net heat rate of a gas turbine, NHR-RC represents the net heat rate of a standard Rankine cycle, NHR-ORC represents the net heat rate of other standard organic Rankine cycles including that of R-Sami 2000 (U.S. Pat. No. 6,101,813), and NHR-ORCN represents the mixture of the present invention as discussed above with reference to FIGS. 6 and 7. The NHR is an indication of the heat used in British Thermal Units (BTUs) to produce power in kilowatt hours (KWh). The NHR is considered as an indicator of the efficiency of a thermal system. The lower values of NHR indicate the most efficient thermal system. It was assumed in these simulations that the system uses an air-cooled condenser; however, using a water cooled condenser will result in higher cycle efficiency and power produced at the turbine shaft.

In light of the wide range of proportions or percentages within which the components of the refrigerants of the present invention fall, and in order to prevent reciting an exhaustive list of percentages falling within these ranges, Applicant reserves the right to claim these percentages using any intervals or increments within the recited ranges, such as, for example, one degree intervals. Likewise, Applicant reserves the right to incrementally claim temperatures which fall within the given ranges.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A system comprising:

a Rankine cycle closed circuit;

a turbine within the closed circuit; and a refrigerant within the closed circuit configured for driving the turbine; wherein the refrigerant is one of a group of nine quaternary organic heat exchange fluid mixtures each having respective first, second, third and fourth components, the group consisting of:

(a) by weight, 1 to 60% HFC245ca, 1 to 69% HFC236ea, 20 to 88% HFC125 and 10 to 78% HFC152a;

(b) by weight, 1 to 85% HFC236ea, 1 to 85% HFC134a, 13 to 97% HFC125 and 1 to 85% HFC152a;

(c) by weight, 1 to 85% HFC245ca, 1 to 85% HFC134a, 13 to 97% HFC125 and 1 to 85% HFC152a;

(d) by weight, 1 to 20% HFC236ea, 1 to 10% HFC245ca, 1 to 10% HFC365mfc and 60 to 97% HFC152a;

(e) by weight, 1 to 25% HFC236ea, 1 to 25% HFC245ca, 20 to 97% HFC125 and 1 to 30% HFC365mfc;

(f) by weight, 1 to 15% HFC245ca, 1 to 15% HFC236ea, 55 to 97% HFC134a and 1 to 15% HFC365mfc;

(g) by weight, 1 to 83% HFC245fa, 2 to 84% HFC236fa, 13 to 95% HFC125 and 2 to 84% HFC134a;

(h) by weight, 1 to 76% HFC236fa, 13 to 88% HFC134a, 7 to 82% HFC125 and 4 to 79% HFC152a; and (i) by weight, 1 to 76% HFC245fa, 10 to 85% HFC134a, 10 to 85% HFC125 and 4 to 79% HFC152a.

2. The system of claim 1 wherein the refrigerant is one of (a), (b), (c), (g) and (h) and comprises by weight about 2 to 35% of its second component.

3. The system of claim 2 wherein the refrigerant is one of (b), (c) and (q) and comprises by weight about 2 to 35% of its fourth component.

4. The system of claim 2 wherein the refrigerant is one of (a), (b), (c), (g) and (h) and comprises by weight about 2 to 25% of its second component.

5. The system of claim 3 wherein the refrigerant is one of (b), (c) and (g) and comprises by weight about 2 to 25% of its fourth component.

6. The system of claim 1 wherein the refrigerant is one of (a), (b), (c), (e), (g), (h) and (i) and comprises by weight no more than about 25% HFC125.

7. The system of claim 6 wherein the refrigerant comprises by weight no more than about 20% HFC125.

8. The system of claim 1 wherein the refrigerant is one of (a), (b), (c), (h) and (i) and comprises by weight no more than about 15% HFC152a.

9. The system of claim 8 wherein the refrigerant comprises by weight no more than about 10% HFC152a.

10. The system of claim 8 wherein the refrigerant comprises by weight no more than about 25% HFC125.

11. The system of claim 1 wherein the refrigerant is one of (g), (h) and (i) and comprises by weight no more than about 25% HFC125.

12. The system of claim 11 wherein the refrigerant comprises by weight no more than about 20% HFC125.

13. The system of claim 11 wherein the refrigerant is one of (h) and (i) and comprises by weight no more than about 15% HFC152a.

14. The system of claim 13 wherein the refrigerant comprises by weight no more than about 10% HFC152a.

15. The system of claim 1 wherein the refrigerant is (g) and comprises by weight about 60 to 81% HFC245fa, 2 to 15% HFC236fa, 13 to 25% HFC125 and 2 to 25% HFC134a.

16. The system of claim 1 wherein the refrigerant is (h) and comprises by weight about 60 to 76% HFC236fa, 2 to 25% HFC134a, 7 to 25% HFC125 and 4 to 15% HFC152a.

17. The system of claim 1 wherein the refrigerant is (i) and comprises by weight about 55 to 76% HFC245fa, 10 to 30% HFC134a, 10 to 25% HFC125 and 4 to 15% HFC152a.

18. The system of claim 1 wherein the refrigerant is (g) and comprises by weight about 35 to 45% HFC245fa, 35 to 45% HFC236fa, 13 to 20% HFC125 and 2 to 20% HFC134a.

19. The system of claim 1 wherein the refrigerant is (h) and comprises by weight about 35 to 45% HFC236fa, 35 to 45% HFC134a, 7 to 20% HFC125 and 4 to 15% HFC152a.

20. The system of claim 1 wherein the refrigerant is (i) and comprises by weight about 35 to 45% HFC245fa, 35 to 45% HFC134a, 10 to 20% HFC125 and 4 to 15% HFC152a.

* * * * *